US005145458A

United States Patent [19]

Girault et al.

[11] Patent Number: 5,145,458

[45] Date of Patent: Sep. 8, 1992

[54] METHOD AND APPARATUS FOR LIFTING GAS STREAMS TO A GREAT ELEVATION IN THE ATMOSPHERE

[76] Inventors: Pablo Girault; Nicolas Grijalva, both of Av. Volcan 120, Mexico City, Mexico

[21] Appl. No.: 548,089

[22] Filed: Jul. 5, 1990

[30] Foreign Application Priority Data

Jul. 5, 1989 [MX] Mexico ..... 16697

[51] Int. Cl.[5] ..... F23J 11/00

[52] U.S. Cl. ..... 454/189; 454/1

[58] Field of Search ..... 98/36, 58, 60; 110/160, 110/161, 162

[56] References Cited

U.S. PATENT DOCUMENTS

| | | | |
|---|---|---|---|
| 512,508 | 1/1894 | Gaul | 110/161 |
| 3,695,192 | 10/1972 | Von Brimer | 110/160 X |
| 3,987,631 | 10/1976 | Heller et al. | 110/160 X |
| 4,649,807 | 3/1987 | Aasen et al. | 110/160 X |

FOREIGN PATENT DOCUMENTS

| | | | |
|---|---|---|---|
| 444882 | 12/1974 | U.S.S.R. | 48/36 |

*Primary Examiner*—Harold Joyce
*Attorney, Agent, or Firm*—Helfgott & Karas, P.C.

[57] ABSTRACT

In a method and apparatus for lifting gas streams, vertical streams of air and/or gases of a great height are artificially formed in the atmosphere, mainly for decontamination purposes, by heating the air throughout a circular area sufficient to produce a shaft effect, so as to form an ascending column of air and/or gases. The air and/or gases are then driven within the column to produce a rotatory movement thereof to form a vortex. Once a column of a sufficient height has been formed, the rotatory driving action on the air and/or gases is interrupted while the heating thereof is maintained so that the vortex is maintained by the lifting force induced by heat.

16 Claims, 4 Drawing Sheets

METHOD AND APPARATUS FOR LIFTING GAS STREAMS TO A GREAT ELEVATION IN THE ATMOSPHERE

FIELD OF THE INVENTION

The present invention refers to a method and an apparatus for lifting gas streams to great elevation in the atmosphere and, more particularly, it is related with a method and an apparatus for the lifting of said gas streams without the use of ducts, chimneys or the like.

BACKGROUND OF THE INVENTION

The problems of the so called "stable" atmospheres in large cities are well known. Said stable atmospheres produce a high environmental pollution, inasmuch as they have as a characteristic thereof that the temperature gradient with respect to the height is inverted, that is, the layers of the atmosphere that are at lower levels are colder than those located at higher elevations. This occurs during the so called "temperature inversion" phenomenon, which causes the lower layers of the atmosphere to remain stable from the metereological standpoint. This is the reason why there is no vertical air circulation and all of the pollution produced in the large cities remains at ground level. It is this layer of air the one which, although some times having a small thickness, normally shows high degrees of pollution.

Even when the use of very high chimneys has been known for a long time as a means for throwing toxic gases to high elevation in the atmosphere which surrounds the large cities, it is also well known that, in order for said chimneys to have an efficient decontaminating effect, the same must be built with considerable heights, which nevertheless in numerous occasions do not accomplish the goal of extracting the contaminants from the lower atmospheric layer which is enclosed by the temperature inversion, which causes the contaminants thrown by the chimneys to remain integrated to the environmental pollution in the large cities.

On the other hand, it is also well known that ozone, which is benefitial element when at high altitudes in the atmosphere, (inasmuch as the upper ozone layer which is at the upper sections of the atmosphere protects the earth against deleterious solar beams, such as ultraviolet radiation) is being depleted for a multiplicity of reasons, while on the other hand ozone is being generated in the lower atmospheric layers by the photochemical reaction of certain contaminants in cities having abundant exposure to sunlight; which is highly dangerous for human life, because it is an irritating gas which affects breathing. Therefore, it has been thought that it would be very convenient to convey the ozone generated at the lower atmospheric layers upwardly to the upper atmospheric layers wherein it may furnish the above mentioned benefitial effects for the earth. However, none of the devices extant in the prior art has been capable of generating a sufficient draft for carrying out such vertical transfer.

OBJECTS OF THE INVENTION

Having in mind the defects of the prior art methods for lifting gases from the lower to the upper levels of the atmosphere, it is an object of the present invention to provide a method for lifting gas streams to great elevation in the atmosphere, which is of very simple nature and does not require conduits or the like to carry out the transfer.

It is another object of the present invention to provide a method for lifting gas streams to a great elevation in the atmosphere, of the above mentioned character, which will not need of the utilization of high chimneys or which may assist said chimneys to more energetically lift said gases without the need of any intricate equipment.

One other object of the present invention is to provide a method for lifting gas streams to a great elevation in the atmosphere, of the above described character, which will be capable of generating ascending streams of gas in the form of vortexes or ascending whirls.

One other and more particular object of the present invention is to provide an apparatus for producing ascending gas streams which are lifted to a great elevation, which will be of a very simple construction and nevertheless of an efficient operation and which will not use any type of long ducts for conducting said gas streams.

The foregoing objects and others ancillary thereto are preferably accomplished as follows:

In accordance with a specific embodiment of the present invention, gas streams are lifted to a great elevation in the atmosphere by means of a method which comprises the steps of heating the air and/or atmospheric gases throughout an area sufficient to create a shaft effect and form an ascending column of the air and/or atmospheric gases, said gas column having a cross section equivalent to said heating area, driving the air and/or atmospheric gases within said column for imparting them a rotatory movement in order to form a vortex or whirl which will contain the ascending column in the manner of an atmospheric duct and, when the ascending column of gases has been fully formed to a sufficient height, interrupting the rotational drive and maintaining the heating to support the ascending vortex continuously fed by the lifting force induced by the heating of the gases. On the other hand, an apparatus for carrying out the above method comprises the combination of a plurality of atmospheric heaters arranged in a suitable array for covering a preferably circular horizontally projected surface, having an area sufficient to create a shaft effect, a peripheral duct of low height, arranged around said heaters for initially guiding the ascending stream of air and/or gases within a column having a cross section limited by said duct, and a driving assembly arranged such that it imparts to said column of air and/or gases a rotational movement capable of forming a vortex or ascending whirl of the air and/or heated gases within said column.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments when read in connection with the accompanying drawings, in which;

DETAILED DESCRIPTION

As it has been already pointed out above, the method and the apparatus of the present invention are useful for lifting gases or air, either pure or contaminated, to high elevations within the atmosphere, which is highly desirable, particularly in the so called stable atmospheres. The method is useful for producing thermal vortexes in an artificial manner, which are ascending streams in the atmosphere, such as those naturally existing as thermal currents which are generated during warm days with a energy/$m^2$ equivalent to one hundredth of the energy that may be applied to a prototype built in accordance with the present invention. These currents can be confirmed by watching birds glide in the air by rotating and ascending without moving their wings, as well as by the movement of gliders and the like.

The method may be used for removing the contaminants from a polluted atmosphere and send them to very high elevations where said contaminants will not damage the environment, which is highly convenient in situations of accidental dissemination or continuous pollution by contaminant, toxic or corrosive gases in the atmosphere at low levels. In this instance, the method may dispose of such gases without the need of neutralizing them or of utilizing very high chimneys. The method of the present invention, on the other hand, may be used instead of chimneys or may extended the action of said chimneys to send the contaminants to higher elevations.

The method may be used for injecting ozone to the higher atmospheric layers in order to replenish the ozone layer which is being depleted by human actions and which is indispensable for protecting the earth against damaging solar rays, such as ultraviolet rays and may also be utilized for extracting the contaminants from highly contaminated lower atmospheres in the cities of the planet. With this process, the upper boundary of the temperature inversion layer may be "perforated", sending the noxious gases to the upper layers where the winds will spread the contaminants out.

The method of the present invention comprises essentially the following steps:

An area is chosen from which the elevation of the gases will be produced, said area, although preserving a satisfactory efficiency when produced in any dimension and shape, must preferably be approximately circular and with a diameter of from about 35 to about 100 m. This area may be at ground level or above the buildings or at any level and in any place.

Figure 1:
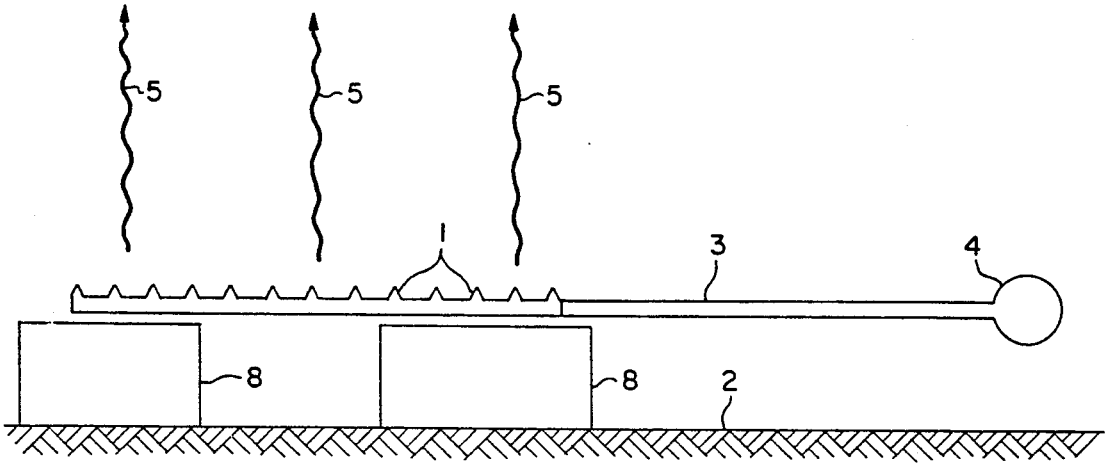
FIG. 1 is an elevational diagrammatic view of an embodiment of the apparatus built in accordance with the present invention.

In the above selected area, an intense heating is produced by means of suitable heaters, such as burners, arranged in any type of array and with any spacing and located at a convenient distance from ground level 2 to secure a correct performance, as it may be seen in FIG. 1 of the drawings.

Figure 2:
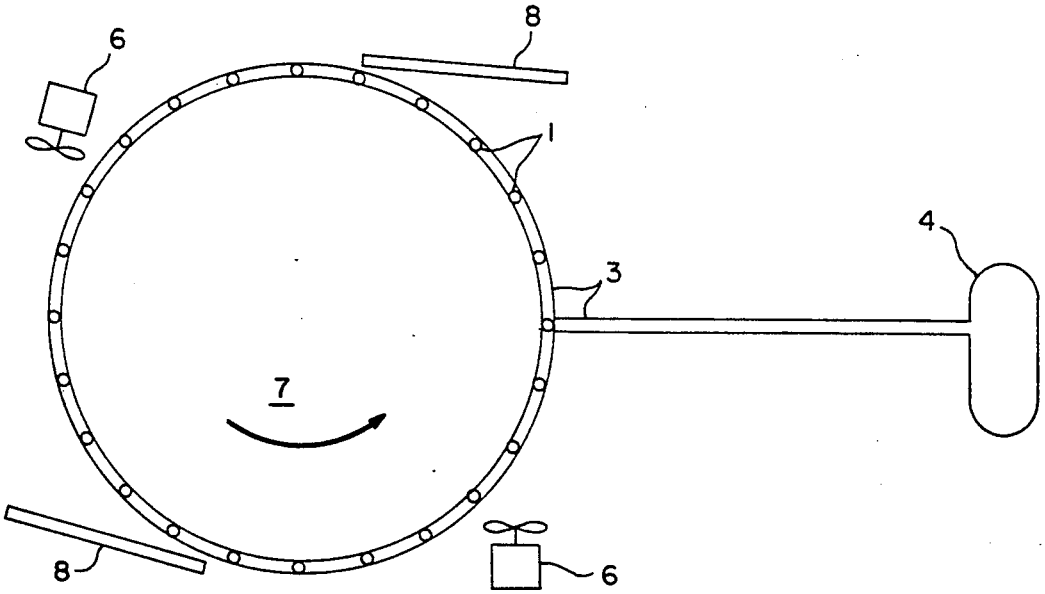
FIG. 2 is a top plan diagrammatic view of the apparatus illustrated in FIG. 1.

The burners, diagrammatically illustrated in FIGS. 1 and 2 of the drawings, are connected by means of pipes 3 or conveying ducts, to the fuel source 4. The fuel may be of any type, such as oil, gasoline, turbosine, coal, nuclear or solar energy, or combinations of any of the above. In the case of solar heat, the heating will be made by means of mirrors or reflectors.

The amount of fuel or heat is calculated in order that the ascending column 5 of air and/or gases may break the upper border of the temperature inversion layer in the predetermined place, in accordance with the temperature, barometric pressures and altitudes of the layer. The air and/or gases heated by the burners will be lifted and will carry the contaminated air upwardly. In order to furnish stability to the ascending air column, such as is shown in FIG. 2 of the drawings, said column is rotated by means of fans, propellers actuated by a motor or by any other device 6, which may induce circulation around a vertical axis 7.

The method and the apparatus of the present invention such as illustrated in its first embodiment in FIGS. 1 and 2, are capable of streaming the gases without the need of a vertical duct, with the air column rotating in any direction or even without rotation. The invention may also include, although this is not indispensable for the good performance of the method, baffles, vanes or walls on the ground or mounted on columns, in approximately tangential arrangement, such as the vanes 8 (FIGS. 1 and 2), for directing the air or the gases which enter through the base, in a tangential direction which will assist in the rotation of the vortex. The height of the baffles, walls or vanes may be varied, as well as the orientation and the number thereof.

Figure 3:
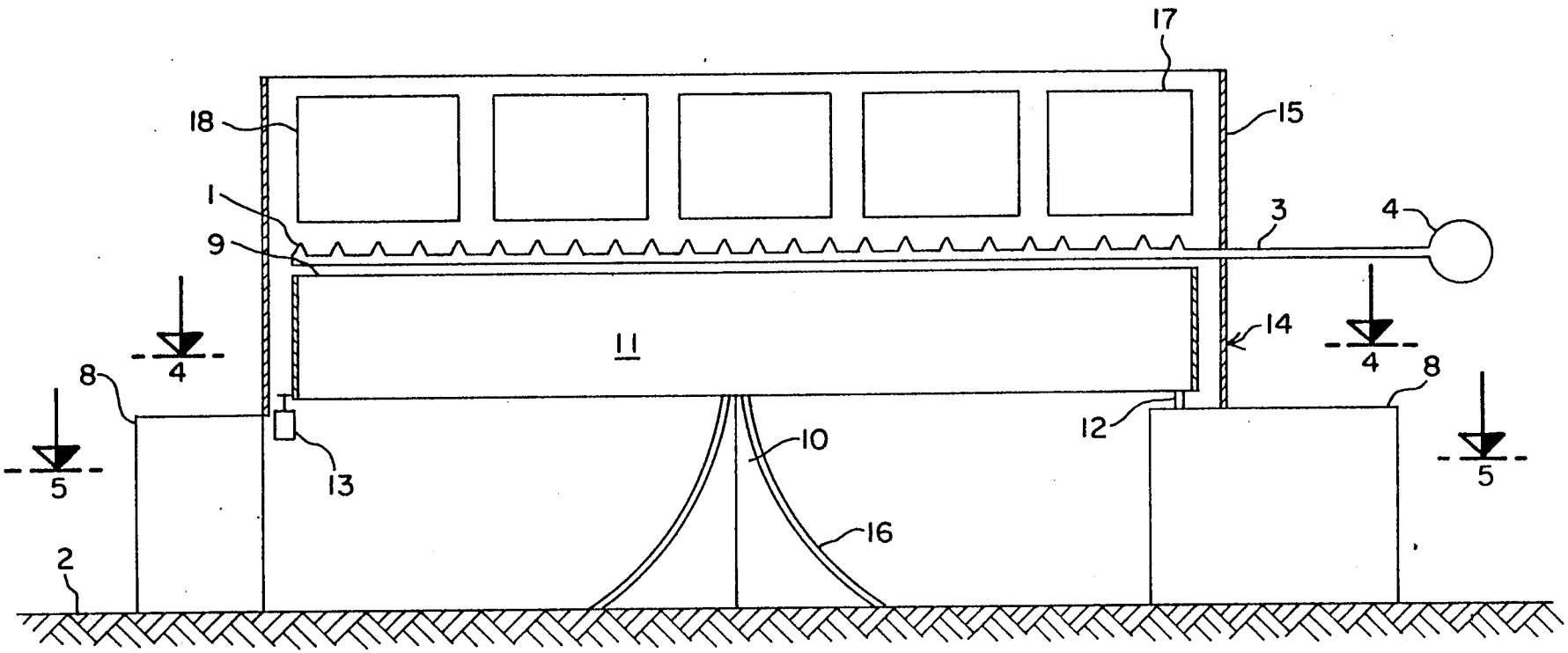
FIG. 3 is a cross sectional elevational diagrammatic view of a second embodiment of the gas driving apparatus built in accordance with the present invention.
Figure 4:
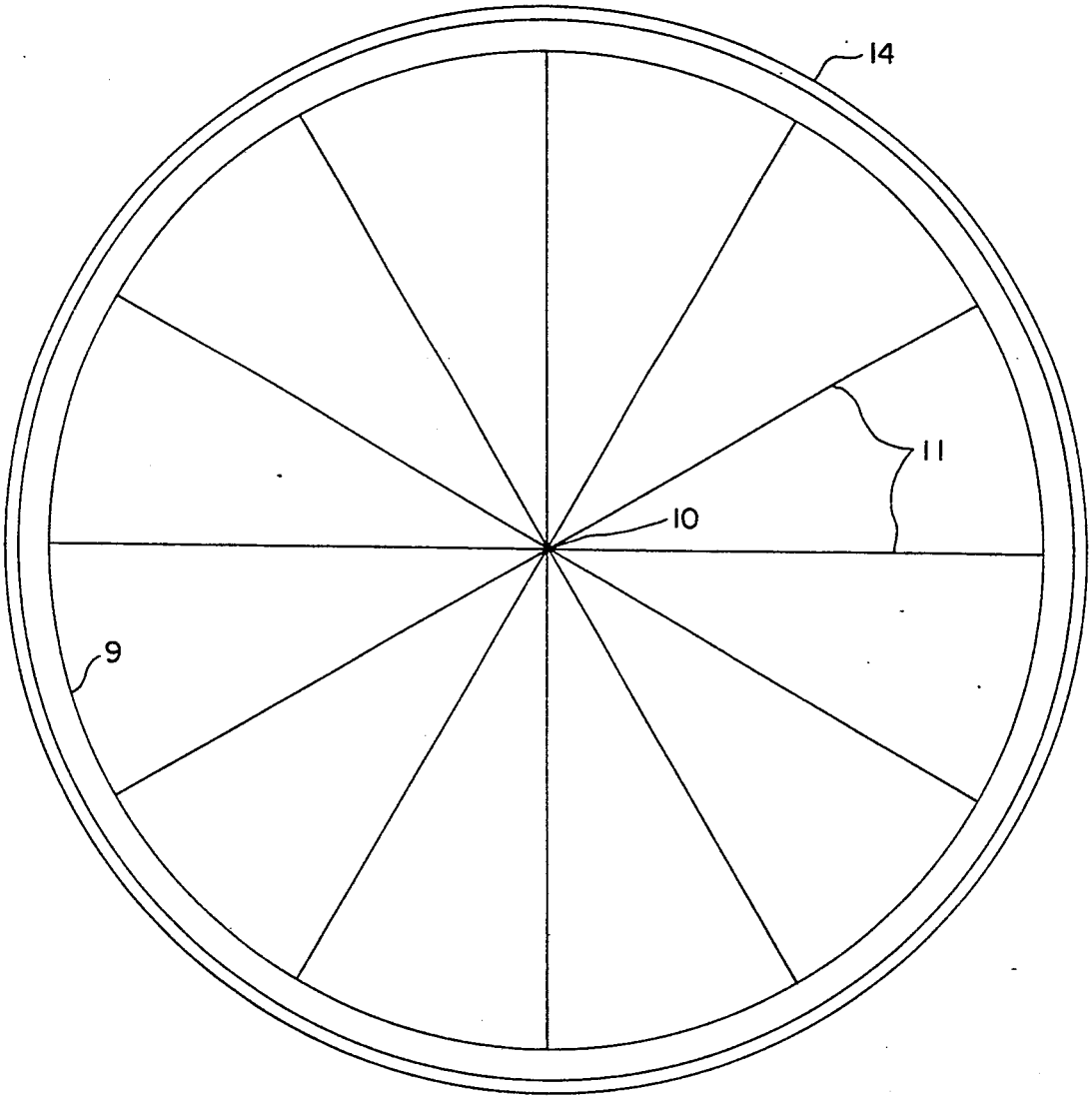
FIG. 4 is a cross sectional diagrammatic plan view taken along lines 4—4 of FIG. 3.
Figure 5:
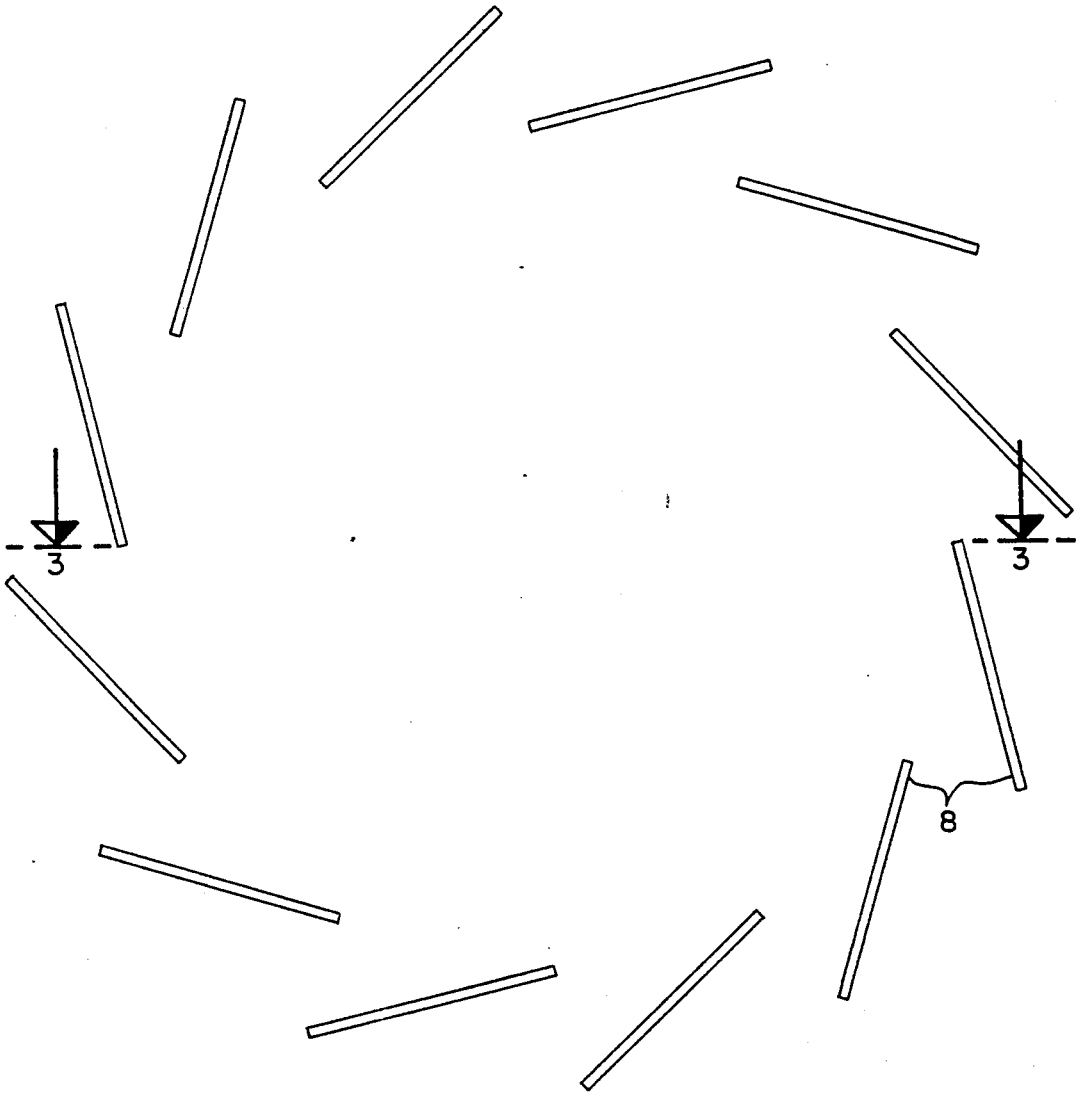
FIG. 5 is a cross sectional diagrammatic view taken along lines 5—5 of FIG. 3, illustrating the tangential gas inlets to the lifting column.

In accordance with the second embodiment of the present invention, the method for lifting the column of air and or gases is effected by means of the utilization of the apparatus illustrated in FIGS. 3 to 5 of the drawings, wherein identical reference numerals are used for designating like parts.

In said figures, it may be seen that the apparatus of the second embodiment of the present invention includes a wheel 9 having a large size, and mounted on a vertical axle 10 which rotates and that, by means of radial rotating vanes 11, imparts a rotating movement to the air which vertically passes therethrough, in order to form the necessary vortex. This wheel is normally supported on a central axle 10 as already mentioned above, or it may be also supported on a periphery, rollers 12 which run along a rail and a motor 13 is installed in order to impart the rotational movement at a suitable speed.

The wheel 9 is located within a cylindrical wall 14, said cylindrical wall having at its upper end section 15 a plurality of openings 17 with movable doors 18 by which said cylindrical wall may be closed or opened. Wheel 9 at its lower end, a deflector 16 having a nearly conical shape, which decreases the turbulence of the air. The baffles for admitting the air in a tangential direction are shown at the lower end of this embodiment of apparatus in accordance with the invention, designated by reference numeral 8, and the orientation of the baffles is indicated in FIG. 5 in a diagrammatic form.

It may be seen from the above that a method and an apparatus have been deviced for forming vertically ascending streams of air and /or gases in the atmosphere which may be lifted to great elevations, without the need of utilizing physical ducts such as very high chimneys, and which is of a high efficiency for removing atmospheric contaminants from the lower layers of the atmosphere and throw the same to the upper layers of the atmosphere that are above the temperature inversion layer in order to allow the winds blowing above said layer to spread the contaminants away.

Even when the utilization of this method and this apparatus is preferably intended for atmospheric decontamination, the same may also be used, as already mentioned above, for the injection of useful gases such as ozone into the upper layers of the atmosphere, where the benefitial effects for the human race are considerable, at the same time removing such gas from the lower atmospheric layers wherein it is deleterious to humankind.

Although certain specific embodiments of the present invention have been shown and described above, it is to be understood that many modifications thereof are possible. The present invention, therefore, is not to be restricted except insofar as is necessitated by the prior art and by the spirit of the appended claims.

What is claimed is:

1. A method of lifting gas streams to a high elevation in the atmosphere, comprising the steps of uniformly heating the air and/or atmospheric gases in a heating zone throughout a circular area sufficient to create shaft effect and to form an ascending column of air and/or atmospheric gases having a cross sectional area equivalent to said area; driving the ascending air and/or gases within said column in order to impart them a rotatory motion thus forming a vortex or whirl which contains the ascending column in the manner of an atmospheric duct; and, after said ascending column has reached a predetermined height, interrupting said driving step while maintaining the heating in order to support the ascending vortex by a lifting force induced by the heat.

2. A method according to claim 1, wherein said rotatory motion is imparted to the ascending gas column by driving the air tangentially from the periphery of said column immediately below the heating zone.

3. A method according to claim 1, wherein said rotatory motion is imparted to the ascending gas column by means of the driving of the gases by vanes carried by a horizontal rotary wheel located within the gas column immediately below the heating zone.

4. A method according to claim 1, wherein said gas column is initially guided by means of a cylindrical wall which surrounds the heating zone so as to restrict the vortex within a predetermined cross sectional area.

5. A method according to claim 3, wherein the gases are fed by said vanes into the gas column in a tangential direction in order to assist in the formation of the vortex.

6. An apparatus for lifting gases to a high elevation in the atmosphere, which comprises a plurality of atmospheric heaters arranged in a suitable array for covering a substantially circular horizontally projected surface having an area sufficient to create a shaft effect; and a driving assembly arranged such that it imparts a rotational movement to said column of air and/or gases, capable of forming a vortex or ascending whirl of the heated air and /or gases within said column.

7. An apparatus according to claim 6, wherein said atmospheric heaters are elected from the group consisting of liquid or solid fuel burners, solar heaters and nuclear energy heaters.

8. An apparatus according to claim 6, and further comprising a cylindrical wall arranged around said heaters for initially guiding the ascending stream of air and/or gases within a column having a cross-section restricted by said cylindrical wall.

9. An apparatus according to claim, 8 wherein said cylindrical wall is provided with inlets for an admission of the gases through a lower portion thereof and under the heaters.

10. An apparatus according to claim 9, wherein said driving assembly comprises a plurality of fans tangentially directed around the periphery of the ascending column of gases and a plurality of baffles tangentially arranged in respect to said column and under said heaters.

11. An apparatus according to claim 10, wherein said plurality of baffles are arranged around the ascending column of gases and in front of the fans, in order to guide the streams of air produced thereby tangentially into said column.

12. An apparatus according to claim 8, wherein said cylindrical wall has a plurality of openings with movable doors, said openings with said doors being provided in an upper end section of said wall for opening and closing said cylindrical wall.

13. An apparatus according to claim 12, wherein said driving assembly comprises a wheel rotatorily driven about an axis coincidentally arranged along the axis of the gas column and under said heaters, said wheel having a plurality of radially arranged vanes which, when the wheel rotates, impart a rotational movement to the column.

14. An apparatus according to claim 13, wherein said wheel is rotatorily supported by an axle vertically arranged in coincident position with an axis of the column of gases.

15. An apparatus according to claim 14, wherein said wheel includes a conical deflector mounted around said axle to smoothly guide the gases upwardly before they are driven by said vanes.

16. An apparatus according to claim 13, wherein said wheel is rotatorily supported on a plurality of rollers which run along a circumferential rail arranged under the wheel and in a position coincident with the periphery of the wheel.

* * * * *